US007344281B2

(12) United States Patent
Okazaki

(10) Patent No.: US 7,344,281 B2
(45) Date of Patent: Mar. 18, 2008

(54) DISPLAY DEVICE HAVING A PROTRUDING LIGHT TRANSMISSION PANEL INCLUDING A LIGHT DIFFUSION PORTION

(75) Inventor: Takeshi Okazaki, Kawasaki (JP)

(73) Assignee: FUJITSU Limited, Kawasaki (JP)

( * ) Notice: Subject to any disclaimer, the term of this patent is extended or adjusted under 35 U.S.C. 154(b) by 638 days.

(21) Appl. No.: 10/292,980

(22) Filed: Nov. 13, 2002

(65) Prior Publication Data

US 2003/0193456 A1 Oct. 16, 2003

(30) Foreign Application Priority Data

Apr. 10, 2002 (JP) ..... 2002-108259

(51) Int. Cl.
*F21V 5/04* (2006.01)

(52) U.S. Cl. ..... 362/335; 362/338; 362/330

(58) Field of Classification Search ..... 362/335–337, 362/326, 332–334, 338–340, 307–311, 559, 362/330, 362

See application file for complete search history.

(56) References Cited

U.S. PATENT DOCUMENTS

| | | | | |
|---|---|---|---|---|
| 1,562,835 | A * | 11/1925 | Kuttler | 362/339 |
| 1,627,895 | A * | 5/1927 | Handlan | 362/335 |
| 2,831,964 | A * | 4/1958 | Diedring | 362/311 |
| 3,246,136 | A * | 4/1966 | Cheng | 362/311 |
| 3,435,203 | A * | 3/1969 | Reading | 362/337 |
| 4,371,916 | A * | 2/1983 | De Martino | 362/337 |
| 4,484,254 | A * | 11/1984 | Puckett et al. | 362/337 |
| 4,491,824 | A * | 1/1985 | Chiou | 340/467 |
| 4,506,316 | A * | 3/1985 | Thiry et al. | 362/309 |
| 4,729,185 | A | 3/1988 | Baba | 40/546 |
| 5,027,258 | A | 6/1991 | Schoniger et al. | 362/31 |
| 5,485,317 | A | 1/1996 | Perissinotto et al. | 359/712 |
| 5,658,072 | A * | 8/1997 | Natsume et al. | 362/336 |
| 5,683,175 | A * | 11/1997 | Golz | 362/338 |
| 5,785,404 | A | 7/1998 | Wiese | 362/32 |
| 6,406,171 | B1 | 6/2002 | Satsukawa et al. | 362/518 |

FOREIGN PATENT DOCUMENTS

| | | |
|---|---|---|
| DE | 36 02 819 A1 | 7/1986 |
| DE | 693 24 575 T 2 | 11/1999 |
| DE | 100 01 860 A1 | 8/2000 |
| DE | 696 15 841 T 2 | 9/2002 |
| EP | 0 403 764 A1 | 4/1990 |
| EP | 1 154 198 A2 | 11/2001 |
| JP | 60-56085 | 4/1985 |
| JP | 63-8933 | 3/1988 |
| JP | 02-091683 | 3/1990 |
| JP | 4-14775 | 4/1992 |
| JP | 4-46487 | 4/1992 |

(Continued)

*Primary Examiner*—Bao Q. Truong
(74) *Attorney, Agent, or Firm*—Greer, Burns & Crain, Ltd.

(57) ABSTRACT

At least one light-emitting diode emitting a light, and a front panel provided at a position forward in a traveling direction of the light emitted from the light-emitting diode, form a display device. In this display device, the front panel is so shaped as to protrude in the traveling direction of the light. An embossed portion diffusing the light emitted from the light-emitting diode is formed on the front panel.

7 Claims, 6 Drawing Sheets

FOREIGN PATENT DOCUMENTS

| | | |
|---|---|---|
| JP | 4-160703 | 6/1992 |
| JP | 05-289622 | 11/1993 |
| JP | 06-348212 | 12/1994 |
| JP | 9-97026 | 4/1997 |
| JP | 9-230805 | 9/1997 |
| JP | 2001-042800 | 2/2001 |

* cited by examiner

DISPLAY DEVICE HAVING A PROTRUDING LIGHT TRANSMISSION PANEL INCLUDING A LIGHT DIFFUSION PORTION

BACKGROUND OF THE INVENTION

1. Field of the Invention

The present invention generally relates to a display device, and more particularly, to a display device provided as a front panel of an electronic apparatus.

2. Description of the Related Art

Generally, an electronic device, such as a personal computer or a peripheral apparatus thereof comprises a case body incorporating circuit substrates and electronic apparatuses, and a front panel provided at a front part of this case body so as to display an operational status of the electronic device. The front panel is detachably attached to the case body so that the electronic device can be assembled and maintained with efficiency. Also, for the same purpose, the case body is often formed by a pair of half case bodies combined with each other.

Conventionally, a display device provided as the front panel generally employs a light-emitting diode exhibiting high brightness with low power consumption. A light emitted from this light-emitting diode is viewed by a user of the electronic device via the front panel. In this structure, the light-emitting diode is not directly exposed outside; therefore, not only the light-emitting diode is protected, but also the electronic device appears nicely.

As mentioned above, since the front panel is required to transmit the light emitted from the light-emitting diode, a transparent panel is used as the front panel. Conventionally, the front panel formed by the transparent panel is structured simply for transmitting light. Additionally, the front panel often has a flat-plate form. The front panel may have a form that is not plane as a whole in terms of design; however, a part at which the light emitted from the light-emitting diode is transmitted is often in a flat-plate form.

In this structure, a range from which a display on the front panel can be viewed depends solely on directions in which the light emitted from the light-emitting diode is radiated. Therefore, when the electronic device is placed away from the user (such being the case for a peripheral apparatus of a personal computer), the user cannot view the display on the front panel.

SUMMARY OF THE INVENTION

It is a general object of the present invention to provide an improved and useful display device in which the above-mentioned problems are eliminated.

A more specific object of the present invention is to provide a display device which can widen a range from which a display of the display device is viewable with simple structure.

In order to achieve the above-mentioned objects, there is provided according to one aspect of the present invention a display device comprising a light-emitting element emitting a light, and a light transmission panel provided at a position forward in a traveling direction of the light emitted from the light-emitting element, wherein the light transmission panel has a shape protruding in the traveling direction of the light emitted from the light-emitting element, and includes a light diffusion portion diffusing the light emitted from the light-emitting element.

According to the present invention, since the light transmission panel has a shape protruding in the traveling direction of the light emitted from the light-emitting element, the light transmission panel is viewable from a wide range, compared to a flat light transmission panel. Additionally, since the light transmission panel includes a light diffusion portion diffusing the light emitted from the light-emitting element, the light emitted from the light-emitting element is diffused by the light diffusion portion so as to illuminate the light transmission panel in a predetermined range centered around a position at which the light-emitting element is provided. Thus, the range from which the light transmission panel can be viewed is widened, and the illuminant range on the light transmission panel is enlarged; accordingly, a range from which an illuminant display on the light transmission panel can be viewed is enlarged, compared to a conventional front panel.

Additionally, in the display device according to the present invention, the light diffusion portion may be an embossed portion formed on the light transmission panel.

According to the present invention, since the embossed portion is a finely uneven portion formed on the light transmission panel, the light emitted from the light-emitting element can be diffused by a simple structure.

Additionally, in the display device according to the present invention, the light transmission panel may have a curved shape protruding in the traveling direction of the light emitted from the light-emitting element.

According to the present invention, an illuminant display on the light transmission panel can be viewed from a wider angle than a front panel comprising two planes joined to form a triangular cross section, for example.

Additionally, in the display device according to the present invention, the light transmission panel may include a non-diffusion portion at a position opposing the light-emitting element, the non-diffusion portion excluding an embossed portion.

According to the present invention, the light emitted from the light-emitting element is not diffused at the non-diffusion portion, and is transmitted through the light transmission panel. Accordingly, a brightness at the non-diffusion portion is intense compared to a brightness at the light diffusion portion; this enables an intensely visible (sharp) display at the position at which the non-diffusion portion is formed. Therefore, the light seems sharp at the non-diffusion portion of the light transmission panel, and the light seems soft at the light diffusion portion provided at the sides of the non-diffusion portion, giving a sophisticated impression to a viewer.

Additionally, in the display device according to the present invention, the non-diffusion portion may be provided with a knurled portion.

According to the present invention, a display becomes sharper at the knurled portion. Therefore, a visibility of the display at the non-diffusion portion is further increased.

Additionally, in the display device according to the present invention, a color of the light emitted from the light-emitting element may be one of an identical color or a similar color to a color of the light transmission panel.

According to the present invention, the light transmission panel exhibits a function as a filter passing only the light emitted from the light-emitting element so as to prevent lights of other colors from affecting a display on the light transmission panel; thus, a visibility of the display on the light transmission panel can be increased also by this color arrangement.

Other objects, features and advantages of the present invention will become more apparent from the following detailed description when read in conjunction with the accompanying drawings.

DETAILED DESCRIPTION OF THE PREFERRED EMBODIMENTS

A description will now be given, with reference to the drawings, of embodiments according to the present invention.

Figure 1A:
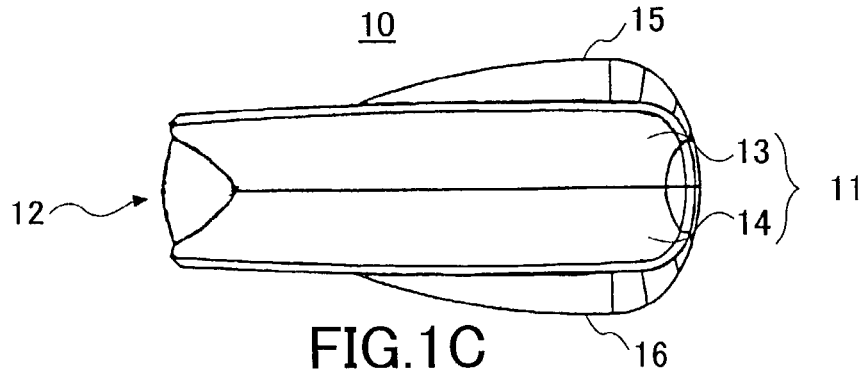
FIG. 1A is a top view of an electronic apparatus adopting an embodiment of the present invention.
Figure 1B:
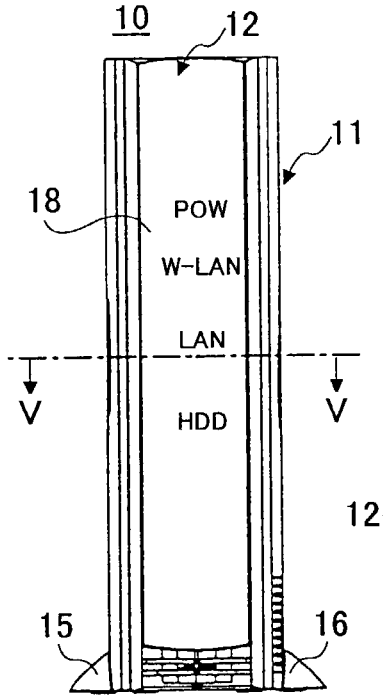
FIG. 1B is a front view of the electronic apparatus shown in FIG. 1A.
Figure 1C:
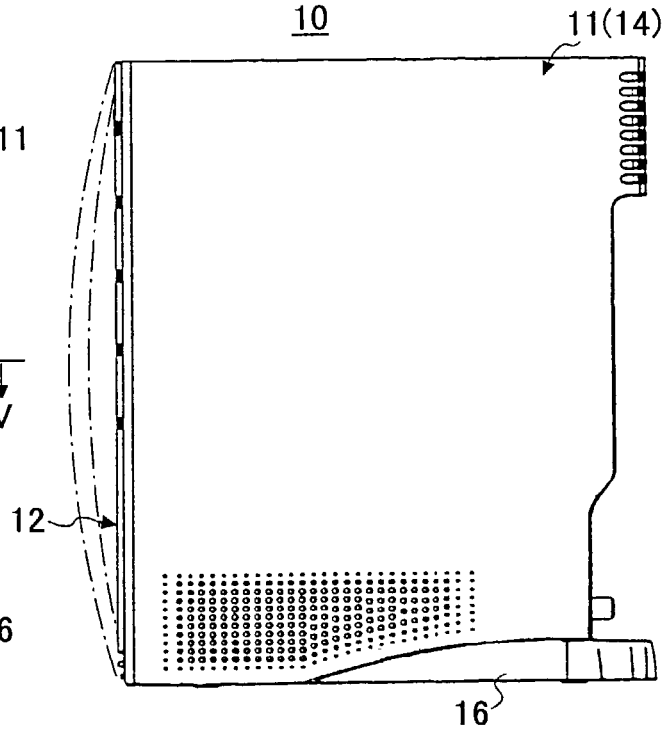
FIG. 1C is a side view of the electronic apparatus shown in FIG. 1A.
Figure 1D:
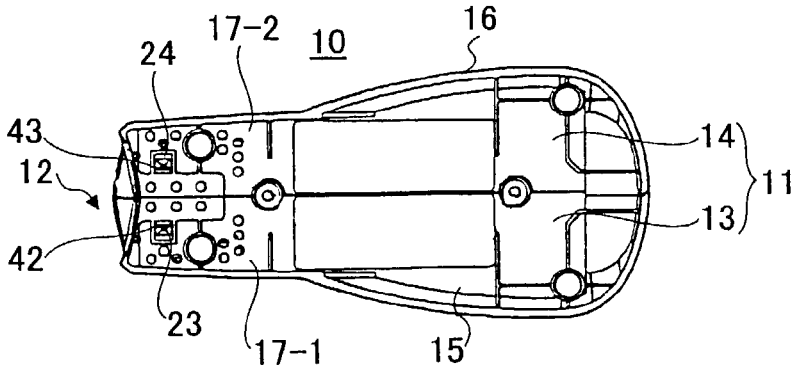
FIG. 1D is a bottom view of the electronic apparatus shown in FIG. 1A.

FIG. 1A is a top view of an electronic device 10 adopting an embodiment of the present invention. FIG. 1B is a front view of the electronic device 10. FIG. 1C is a side view of the electronic device 10. FIG. 1D is a bottom view of the electronic device 10. In the present embodiment, the electronic device 10 is exemplified by a router which is a peripheral apparatus of a personal computer; however, the present invention is not limitedly applied thereto, but is applicable to various types of apparatuses.

The electronic device 10 mainly comprises a case body 11 and a front panel 12. In the present embodiment, each of the case body 11 and the front panel 12 is a resinous molding. However, the present invention is also applicable when the case body 11 and the front panel 12 are formed of other materials, such as metals.

The case body 11 comprises a pair of a half case body 13 and a half case body 14 combined with each other. Since the case body 11 has a structure formed by the half case body 13 and the half case body 14 combined, it is easy to mount circuit substrates and electronic devices in the case body 11, and also is easy to perform maintenance therefor. In addition, collar parts 15 and 16 are formed at lower positions of the case body 11 so as to increase placement stability of the case body 11.

Figure 2:
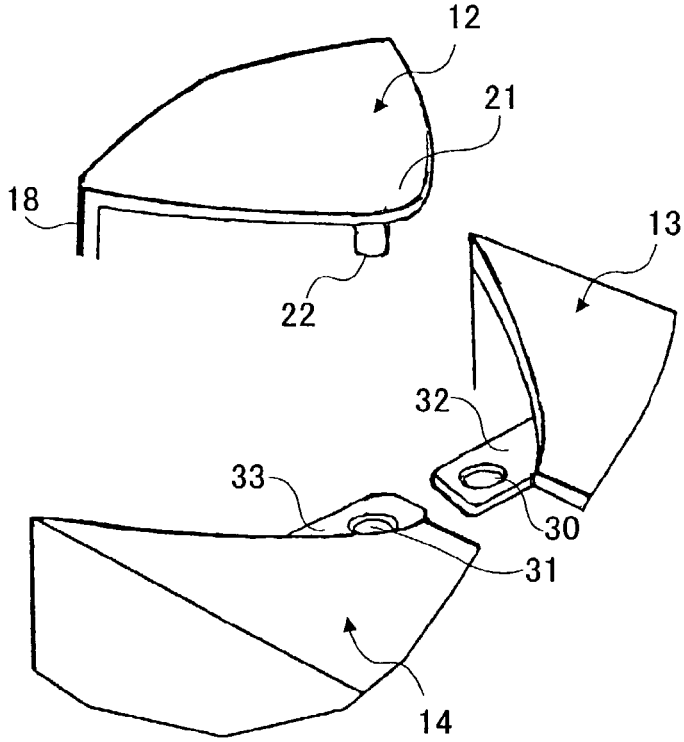
FIG. 2 is a first magnification view of a part at which an engagement projection engages engagement holes.
Figure 3:
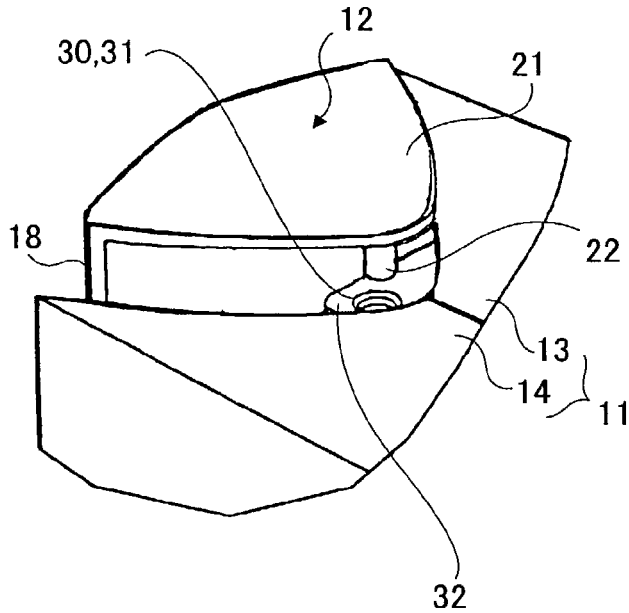
FIG. 3 is a second magnification view of the part at which the engagement projection engages the engagement holes.

As shown in FIG. 2 and FIG. 3, the half case body 13 includes an extending portion 32 at an upper position thereof, and an engagement hole 30 is formed in the extending portion 32. On the other hand, the half case body 14 includes an extending portion 33 at an upper position thereof, and an engagement hole 31 is formed in the extending portion 33. The extending portion 32 of the half case body 13 is so formed as to extend toward the half case body 14. The extending portion 33 of the half case body 14 is so formed as to extend toward the half case body 13.

When the half case body 13 and the half case body 14 are combined, the extending portion 32 and the extending portion 33 overlap each other. When the extending portion 32 and the extending portion 33 overlap each other, the engagement hole 30 formed in the extending portion 32 and the engagement hole 31 formed in the extending portion 33 communicate with each other. An engagement projection 22 formed in the front panel 12 engages the engagement holes 30 and 31, as described hereinafter.

Further, as shown in FIG. 1D, fixation hooks 42 and 43 are formed at a bottom surface of the case body 11. The fixation hook 42 is formed at a bottom surface 17-1 of the half case body 13. The fixation hook 43 is formed at a bottom surface 17-2 of the half case body 14. Fixation claws 23 and 24 formed in the front panel 12 engage the fixation hooks 42 and 43, respectively, as described hereinafter.

When the half case body 13 and the half case body 14 are combined as mentioned above, a front part of the case body 11 is opened. The front panel 12 is mounted so as to cover this opening of the case body 11.

Figure 4A:
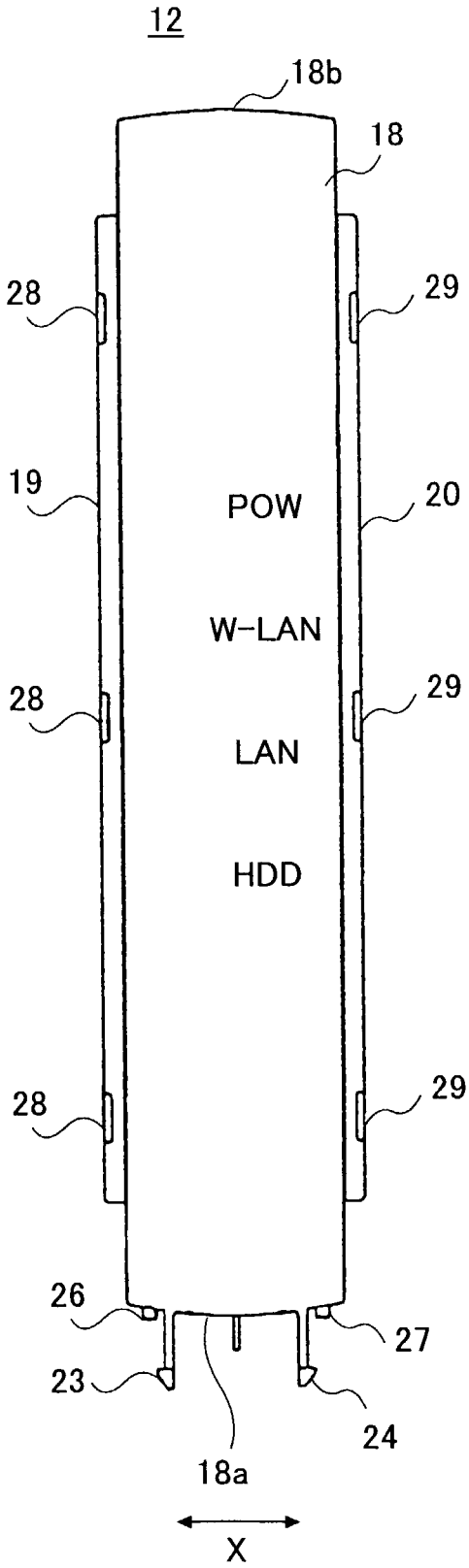
FIG. 4A is a front view of a front panel.
Figure 4B:
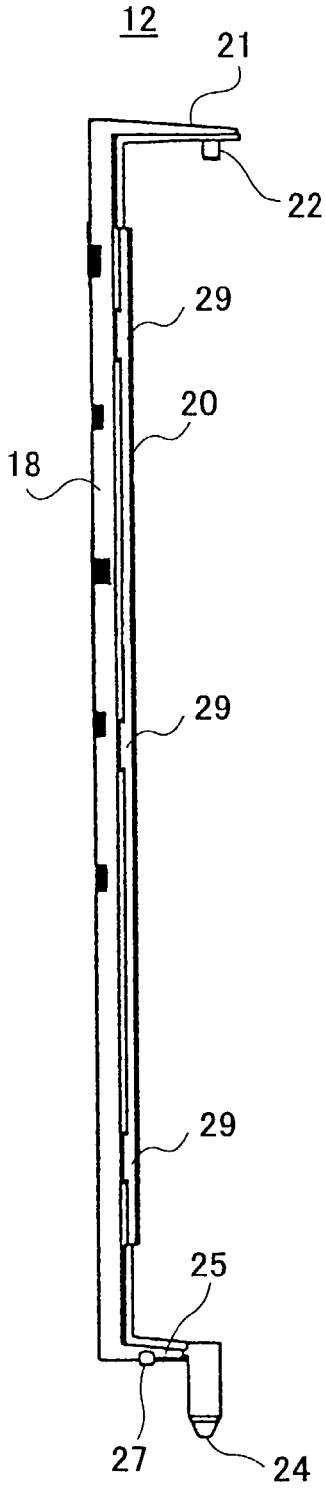
FIG. 4B is a side view of the front panel shown in FIG. 4A.

FIG. 4A is a front view of the front panel 12. FIG. 4B is a side view of the front panel 12. The front panel 12 is a resinous molding, and mainly comprises a panel body 18, sidepieces 19 and 20, the engagement projection 22, the fixation claws 23 and 24, an embossed portion 40, and a knurled portion 41 (the embossed portion 40 and the knurled portion 41 shown in FIG. 5 and FIG. 7 and to be described hereinafter with reference to).

The panel body 18 has a substantially rectangular form when viewed from front, as shown in FIG. 4A. The panel body 18 is provided with predetermined function indications (such as POW) on a surface thereof. As described hereinafter, a vicinity of the function indication corresponding to a function in operation is illuminated by a light emitted from a corresponding light-emitting diode 37 (shown in FIG. 5). Accordingly, a user of the electronic device 10 can ascertain an operational status of the electronic device 10 by viewing the above-mentioned light. Besides, at least the front panel 12 and the light-emitting diodes 37 compose a display device for displaying operational statuses of the electronic device 10.

Figure 5:
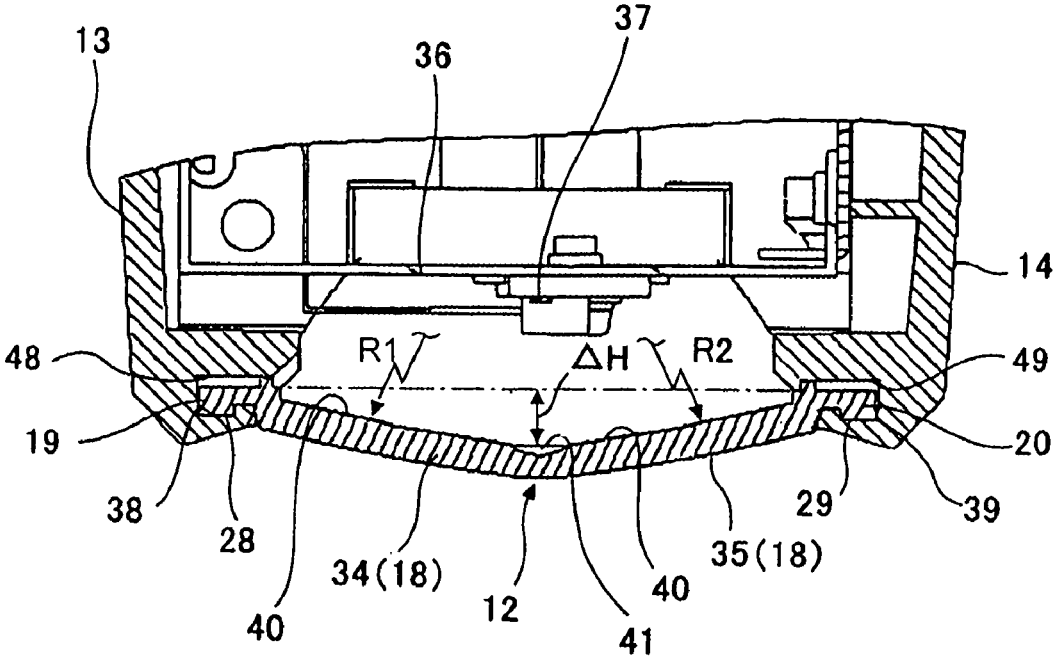
FIG. 5 is a sectional view taken along a line V-V in FIG. 1B.

The sidepieces 19 and 20 are formed at longer sides of the front panel 12. As shown in FIG. 5, the sidepieces 19 and 20 engage slid-in recesses 48 and 49 formed in the half case body 13 and the half case body 14, respectively, so as to slide thereon.

As described hereinafter, the front panel 12 is mounted on the case body 11 by sliding thereinto. In this course, the sidepieces 19 and 20 are guided by the slid-in recesses 48 and 49 so that the front panel 12 is mounted on the case body 11.

Additionally, as shown in FIG. 4A, a plurality (three on each side in the present embodiment) of protrusions 28 and 29 are formed in the sidepieces 19 and 20, respectively. Correspondingly, as shown in FIG. 5, engagement recesses 38 and 39 are formed at predetermined positions in the half case body 13 and the half case body 14, respectively. The protrusions 28 and 29 engage the respective engagement recesses 38 and 39 when the front panel 12 is mounted at a predetermined mounting position on the case body 11.

At an upper position of the front panel 12, an upper arm portion 21 extending inward (rightward in FIG. 4B) is formed unitary with the panel body 18. The engagement projection 22 projecting downward in FIG. 4B is formed at an end of the upper arm portion 21.

At a lower position of the front panel 12, a lower arm portion 25 extending inward (rightward in FIG. 4B) is formed unitary with the panel body 18. The fixation claws 23 and 24 extending downward in FIG. 4B are formed at an end of the lower arm portion 25, and fixation protrusions 26 and 27 are formed about midway on the lower arm portion 25.

The fixation claws 23 and 24 extend downward in a longitudinal direction of the panel body 18 from a lower side 18*a* that is one of shorter sides of the panel body 18. Thus, the fixation claws 23 and 24 are in the form of cantilevers extending from the panel body 18, and are elastically deformable. The fixation claws 23 and 24 undergo elastic deformations in directions (indicated by a double-pointed arrow X in FIG. 4A) parallel to the shorter side of the substantially rectangular panel body 18.

Subsequently, a description will be given, with reference to FIG. 2, FIG. 3, FIG. 5 and FIG. 6, of a method for mounting the front panel 12 on the case body 11.

In the course of mounting the front panel 12 on the case body 11, first, the half case body 13 and the half case body 14 are placed opposite each other as shown in FIG. 2, and then are combined. Accordingly, as shown in FIG. 3, the extending portion 32 and the extending portion 33 overlap each other so that the engagement hole 30 and the engagement hole 31 communicate with each other.

Subsequently, as shown in FIG. 3, the front panel 12 is mounted on the case body 11 by sliding thereinto. In this course, first, the sidepieces 19 and 20 are positioned in the slid-in recesses 48 and 49 as shown in FIG. 5, and then the front panel 12 is mounted on the case body 11 by sliding from upward to downward in FIG. 3. Thus, upon mounting, the front panel 12 is inserted to the case body 11 while being guided by sliding; therefore, the front panel 12 can be mounted on the case body 11 with ease.

Then, when the front panel 12 is completely mounted on the case body 11, the engagement projection 22 is inserted into the communicating engagement holes 30 and 31, at the upper position of the front panel 12, so that the front panel 12 is fixed to the case body 11. Concurrently, at the lower position of the front panel 12, the fixation claws 23 and 24 engage the fixation hooks 42 and 43 formed at the bottom surfaces 17-1 and 17-2 of the half case body 13 and the half case body 14, respectively, so that the front panel 12 is fixed to the case body 11.

Thus, the front panel 12 is mounted on the case body 11 by sliding thereinto so that the front panel 12 is fixed to the case body 11 concurrently at the upper position and the lower position of the front panel 12; accordingly, the electronic device 10 can be assembled with improved efficiency.

Next, descriptions will be given of a mounting structure of the front panel 12 and the case body 11 at an upper position of the electronic device 10, and a mounting structure of the front panel 12 and the case body 11 at a lower position thereof.

As mentioned above, when the front panel 12 is completely mounted on the case body 11, the engagement projection 22 is inserted into the communicating engagement holes 30 and 31, at the upper position of the front panel 12. Thereby, the engagement projection 22 engages the engagement holes 30 and 31. Thus, at the upper position of the electronic device 10, the front panel 12 and the case body 11 (the half case body 13 and the half case body 14) are unified by the engagement projection 22 engaging the engagement holes 30 and 31.

Thus, at the upper position of the electronic device 10, a process of combining the pair of the half case body 13 and the half case body 14 and a process of mounting the front panel 12 on the case body 11 are performed consecutively so that the electronic device 10 can be assembled with improved efficiency. Besides, upon disassembling the electronic device 10 for maintenance and so on, a process of separating the pair of the half case body 13 and the half case body 14 and a process of dismounting the front panel 12 from the case body 11 are performed consecutively so that the electronic device 10 can be maintained with improved efficiency.

Figure 6:
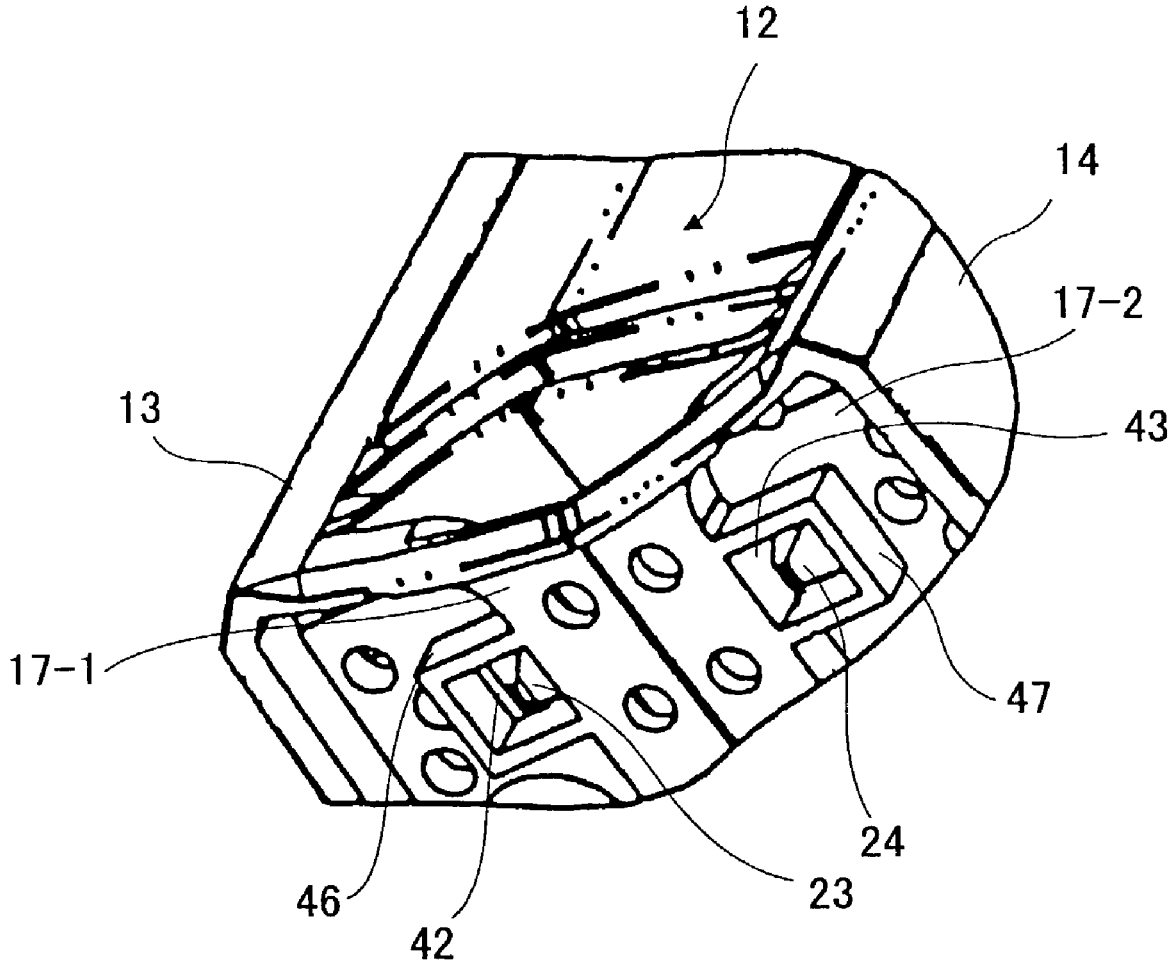
FIG. 6 is a magnification view of a part at which fixation claws engage fixation hooks.

On the other hand, when the front panel 12 is completely mounted on the case body 11, the fixation claws 23 and 24 engage the fixation hooks 42 and 43 formed at the bottom surfaces 17-1 and 172 of the half case body 13 and the half case body 14, respectively, at the lower position of the front panel 12. FIG. 6 shows a state where the fixation claws 23 and 24 engage the fixation hooks 42 and 43, respectively. Additionally, the fixation protrusions 26 and 27 engage respective fixation recesses (not shown in the figure) formed in the half case body 13 and the half case body 14. Accordingly, the front panel 12 is fixed to the half case body 13 and the half case body 14 also at the lower position thereof.

In this course, when the fixation claws 23 and 24 engage the fixation hooks 42 and 43, the fixation claws 23 and 24 undergo elastic deformations; accordingly, reaction forces of the elastic deformations act on the front panel 12. Conventionally, as mentioned above, fixation claws fixing a front panel to half case bodies are provided at upper and lower ends (corresponding to the lower side 18*a* and an upper side 18*b* in the present embodiment) so that reaction forces due to elastic deformations of the fixation claws upon fixing are applied in longitudinal directions of the front panel; therefore, the front panel 12 may possibly be distorted as indicated by a single-dashed chain line in FIG. 1C.

However, in the above-described mounting structure of the front panel 12, the reaction forces of the elastic deformations of the fixation claws 23 and 24 act in the directions (indicated by the double-pointed arrow X in FIG. 4A) parallel to the shorter side of the panel body 18. That is, these reaction forces act in directions in which the front panel 12 has a higher rigidity. Therefore, even when these reaction forces act on the front panel 12, the front panel 12 is not warped because the front panel 12 has a higher rigidity in the directions in which these reaction forces act. Accordingly, the front panel 12 and the case body 11 form no gap therebetween; this prevents dust from entering the electronic device 10.

Besides, in the above-described mounting structure, the fixation claws 23 and 24 are formed only at the lower side 18*a* in contrast to the conventional fixation claws provided at the upper and lower ends, and elastic forces (the reaction forces) of the fixation claws 23 and 24 are selectively caused to act in the directions in which the front panel 12 has a higher rigidity; this simple structure prevents the front panel 12 from being warped. Thus, according to this simple mounting structure, the front panel 12 can be mounted more reliably.

Further, in the above-described mounting structure, whereas the engagement projection 22 is only inserted into the engagement holes 30 and 31 at the upper position, the fixation claws 23 and 24 engage the fixation hooks 42 and 43, respectively, at the lower position; therefore, the front panel 12 does not move in a downward or upward direction (in which the front panel 12 is slid into or out of the case body 11). Accordingly, the engagement projection 22 is not detached from the engagement holes 30 and 31.

Besides, when the front panel 12 is completely mounted on the case body 11, the protrusions 28 and 29 formed in the sidepieces 19 and 20 engage the respective engagement recesses 38 and 39 formed in the half case body 13 and the half case body 14. Thus, the front panel 12 firmly engages the case body 11 also by these protrusions 28 and 29 engaging the engagement recesses 38 and 39 so as to prevent a gap from being formed between the front panel 12 and the case body 11.

Additionally, as shown in FIG. 6, quadrilateral walls 46 and 47 are formed at perimeters of positions at which the fixation claws 23 and 24 engage the fixation hooks 42 and 43, respectively. Thus, the perimeters of the positions at which the fixation claws 23 and 24 engage the fixation hooks 42 and 43 are covered with the quadrilateral walls 46 and 47 so as to prevent erroneous disengagement of the fixation claws 23 and 24 from the fixation hooks 42 and 43.

Hereinbelow, descriptions will be given of a back surface of the front panel 12 and of a relation between the front panel 12 and the light-emitting diodes 37.

As mentioned above, the vicinity of the function indication of the panel body 18 is illuminated by the corresponding light-emitting diode 37. That is, the light emitted from the light-emitting diode 37 is transmitted through the front panel 12, and is viewed by an operator. At this point, the router exemplifying the electronic device 10 of the present embodiment is generally placed away from a personal computer that the operator mainly operates; accordingly, the electronic device 10 is also positioned away from the operator. Under this condition, a function indication in conventional manners cannot always be viewed by the operator.

Figure 7:
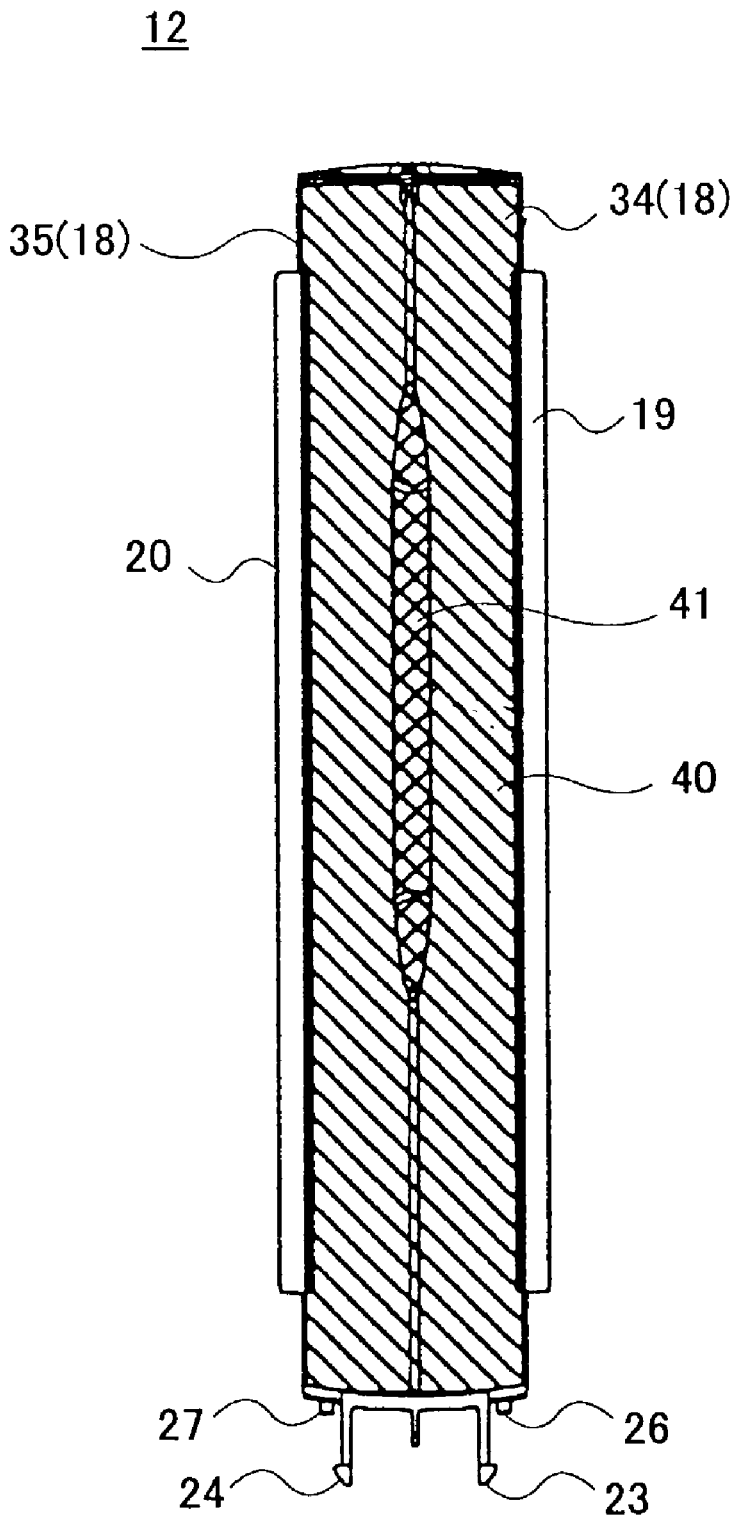
FIG. 7 is a rear view of the front panel shown in FIG. 4A and FIG. 4B.

Thereupon, in the present embodiment, the front panel 12 (a light transmission panel) has a shape protruding in a traveling direction of the light emitted from each of the light-emitting diodes 37, as shown in FIG. 5, and the embossed portion 40 diffusing the light emitted from each of the light-emitting diodes 37 is formed at the back surface of the front panel 12, as shown in FIG. 7. Further, the knurled portion 41 is formed at a central position on the back surface of the front panel 12 along a longitudinal direction thereof. Hereinbelow, descriptions will be given of these elements in detail.

FIG. 5 is a sectional view taken along a line V-V in FIG. 1B. As shown in FIG. 5, a substrate 36 is provided in the case body 11 comprising the half case body 13 and the half case body 14. The light-emitting diodes 37 are provided at predetermined positions on the substrate 36, and emit lights or put out the lights according to operational statuses of the electronic device 10. Although the sectional view of FIG. 5 shows only one of the light-emitting diodes 37, the light-emitting diodes 37 are provided in numbers corresponding to a number of the function indications provided on the surface of the panel body 18.

The front panel 12 opposing the light-emitting diodes 37 comprises a left panel 34 having a curvature R1 and a right panel 35 having a curvature R2. The left panel 34 and the right panel 35 are joined so as to form the front panel 12 having the shape protruding as a whole in the traveling direction of the light emitted from each of the light-emitting diodes 37.

Specifically, the front panel 12 protrudes by a dimension indicated by an arrow ΔH in FIG. 5, compared to a conventional plane front panel. Thus, the front panel 12 is provided with the shape protruding in the traveling direction of the light emitted from each of the light-emitting diodes 37 so that the front panel 12 can be viewed from a wide range, compared to a conventional plane front panel.

That is, whereas indications displayed on a plane front panel cannot be viewed from right beside an electronic device comprising the plane front panel, indications displayed on the protruding front panel 12 can be viewed even from right beside the electronic device 10.

Further, as mentioned above, the front panel 12 comprises the left panel 34 having the curvature R1 and the right panel 35 having the curvature R2 joined to each other. Additionally, a center of curvature of the left panel 34 and a center of curvature of the right panel 35 form an eccentricity.

Accordingly, even when the electronic device 10 is downsized, the foregoing protrusion dimension ΔH (i.e., a protrusion amount of the front panel 12) can be made relatively large, compared to a front panel comprising a left panel and a right panel having centers of curvature forming a concentricity; thus, the front panel 12 can be viewed from a wide range, also due to the above-mentioned eccentricity. Besides, the front panel 12 can be viewed from a wide range, also compared to a front panel comprising two planes joined to form a triangular cross section, for example.

In addition, the embossed portion 40 (a light diffusion portion) diffusing the light emitted from each of the light-emitting diodes 37 is formed at the back surface of the front panel 12. In the present embodiment, the embossed portion 40 is formed throughout the back surface of the front panel 12 except the position at which the knurled portion 41 is formed. A fine unevenness can be formed easily by embossing. Therefore, the embossed portion 40 can be formed easily and inexpensively.

The finely uneven embossed portion 40 is formed at the back surface of the front panel 12 so that the light emitted from each of the light-emitting diodes 37 is diffused upon passing the embossed portion 40.

The light emitted from each of the light-emitting diodes 37 is diffused by the embossed portion 40 so that a predetermined range centered around the position at which the light-emitting diode 37 is provided seems illuminant to the operator viewing the front panel 12. Accordingly, the illuminant range is large compared to a front panel not provided with the embossed portion 40 This also widens the range from which the front panel 12 can be viewed.

However, a brightness of the light is decreased at a part at which the embossed portion 40 is formed, because the light is diffused by the embossed portion 40. Some operators prefer a sharp display on the front panel 12.

Thereupon, in the present embodiment, the embossed portion 40 is not formed throughout the back surface of the front panel 12, and a non-diffusion portion excluding the embossed portion 40 is provided at a part of the back surface of the front panel 12. Specifically, the knurled portion 41 is provided on the front panel 12 as the non-diffusion portion.

Accordingly, the light emitted from each of the light-emitting diodes 37 is not diffused at the position the knurled portion 41 is formed, but is transmitted therethrough. Accordingly, a brightness at the knurled portion 41 is intense compared to the brightness at the embossed portion 40; this enables an intensely visible (sharp) display at the position at which the knurled portion 41 is formed. Therefore, the light seems sharp at the knurled portion 41 of the front panel 12, and the light seems soft at the embossed portion 40 provided at the sides of the knurled portion 41, giving a sophisticated impression to a viewer.

Further, in the present embodiment, the light emitted from each of the light-emitting diodes 37 and the front panel 12 have the same color or like colors. Accordingly, the front panel 12 functions as a filter passing only the light emitted from each of the light-emitting diodes 37. Thereby, lights of other colors are prevented from affecting a display on the front panel 12; thus, a visibility of the display on the front panel 12 can be increased also by this color arrangement.

The present invention is not limited to the specifically disclosed embodiments, and variations and modifications may be made without departing from the scope of the present invention.

The present application is based on Japanese priority application No. 2002-108259 filed on Apr. 10, 2002, the entire contents of which are hereby incorporated by reference.

What is claimed is:

1. A display device comprising:

a light-emitting element emitting a light; and a light transmission panel provided at a position forward in a traveling direction of the light emitted by said light-emitting element, and having a length, a width, a thickness, and a curved shape across substantially all of said length, said curved shape protruding in the traveling direction of the light, which is in a direction of said thickness, wherein said light transmission panel comprises an embossed portion formed on a back surface of said light transmission panel in order to diffuse the light emitted by said light-emitting element, and a non-diffusion portion formed on the back surface of said light transmission panel at a central position along substantially all of said length, opposing said light-emitting element, in order to transmit the emitted light through said light transmission panel, and the embossed portion is provided on said back surface other than where the non-diffusion portion is provided.

2. A display device comprising:

a light-emitting element emitting a light; and a light transmission panel provided at a position forward in a traveling direction of the light emitted by said light-emitting element, and having a length, a width, a thickness, and a curved shape across substantially all of said length, said curved shape protruding in the traveling direction of the light, which is in a direction of said thickness, wherein said light transmission panel comprises an embossed portion formed on a back surface of said light transmission panel in order to diffuse the light emitted by said light-emitting element, and a non-diffusion portion formed on the back surface of said light transmission panel at a central position along substantially all of said length, opposing said light-emitting element, in order to transmit the emitted light through said light transmission panel, and the embossed portion is provided on said back surface other than where the non-diffusion portion is provided, and wherein said non-diffusion portion is provided with a knurled portion.

3. The display device comprising:

a light-emitting element emitting a light; and a light transmission panel provided at a position forward in a traveling direction of the light emitted by said light-emitting element, and having a curved shape protruding in the traveling direction of the light, wherein said light transmission panel comprises an embossed portion formed on a back surface of said light transmission panel in order to diffuse the light emitted by said light-emitting element, and a non-diffusion portion formed on the back surface of said light transmission panel at a central position, opposing said light-emitting element, in order to transmit the emitted light through said light transmission panel, and the embossed portion is provided on said back surface other than where the non-diffusion portion is provided, and wherein a color of the light emitted from said light-emitting element is one of an identical color or a similar color to a color of said light transmission panel.

4. The display device comprising:

a light-emitting element emitting a light; and a light transmission panel provided at a position forward in a traveling direction of the light emitted by said light-emitting element, and having a curved shape protruding in the traveling direction of the light, wherein said light transmission panel comprises an embossed portion formed on a back surface of said light transmission panel in order to diffuse the light emitted by said light-emitting element, and a non-diffusion portion formed on the back surface of said light transmission panel at a central position, opposing said light-emitting element, in order to transmit the emitted light through said light transmission panel, and the embossed portion is provided on said back surface other than where the non-diffusion portion is provided, wherein said non-diffusion portion is provided with a knurled portion, and wherein a color of the light emitted from said light-emitting element is one of an identical color or a similar color to a color of said light transmission panel.

5. An electronic apparatus in which a display device is provided, the display device comprising:

a light-emitting element emitting a light; and a light transmission panel provide at a position forward in a traveling direction of the light emitted by said light-emitting element, and having a length, a width, a thickness, and a curved shape across substantially all of said length, said curved shape protruding in the traveling direction of the light, which is in a direction of said thickness, wherein said light transmission panel comprises an embossed portion formed on the back surface of said light transmission panel in order for diffusing the light emitted by said light-emitting element, and a non-diffusion portion formed on the back surface of said light transmission panel at a central portion along substantially all of said length, opposing said light-emitting element, in order for transmitting the emitted light through said light transmission panel, and the embossed portion is not provided on said back surface where the non-diffusion portion is provided.

6. The electronic apparatus in which a display device is provided, the display device comprising:

a light-emitting element emitting a light; and a light transmission panel provide at a position forward in a traveling direction of the light emitted by said light-emitting element, and having a curved shape protruding in the traveling direction of the light, wherein said light transmission panel comprises an embossed portion formed on the back surface of said light transmission panel in order for diffusing the light emitted by said light-emitting element, and a non-diffusion portion formed on the back surface of said light transmission panel at a central portion, opposing said light-emitting element, in order for transmitting the emitted light through said light transmission panel, and the embossed portion is not provided on said back surface where the non-diffusion portion is provided, and wherein a color of the light emitted from said light-emitting element is one of an identical color or a similar color to a color of said light transmission panel.

7. An electronic apparatus in which a display device is provided, the display device comprising:

a light-emitting element emitting a light; and a light transmission panel provided at a position forward in a traveling direction of the light emitted by said light-emitting element, and having a length, a width, a thickness and a curved shape across substantially all of said length, said curved shape protruding in the traveling direction of the light, which is in a direction of said thickness, wherein the light transmission panel comprises an embossed portion formed on a back surface of said light transmission panel in order for diffusing the light emitted by said light-emitting element, and a non-diffusion portion formed on the back surface of said light transmission panel at a central position along substantially all of said length, opposing said light-emitting element, in order for transmitting the emitted light through said light transmission panel, and the embossed portion is not provided on said back surface where the non-diffusion portion is provided, wherein said non-diffusion portion is provided with a knurled portion.

* * * * *